US008359977B2

(12) United States Patent
Andrzejak

(10) Patent No.: US 8,359,977 B2
(45) Date of Patent: Jan. 29, 2013

(54) MINIATURE SHAPED CHARGE FOR INITIATOR SYSTEM

(75) Inventor: Timothy A. Andrzejak, Missouri City, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 385 days.

(21) Appl. No.: 12/393,027

(22) Filed: Feb. 25, 2009

(65) Prior Publication Data

US 2010/0162911 A1 Jul. 1, 2010

Related U.S. Application Data

(60) Provisional application No. 61/140,949, filed on Dec. 27, 2008.

(51) Int. Cl.
*F42B 1/036* (2006.01)

(52) U.S. Cl. ..... 102/206; 86/20.1

(58) Field of Classification Search ..... 102/313, 102/306, 307, 305, 311, 318, 322, 204; 175/4.6, 175/4.55; 166/299; 86/20.1, 20.14, 1.1; 89/1.151

See application file for complete search history.

(56) References Cited

U.S. PATENT DOCUMENTS

| | | | | |
|---|---|---|---|---|
| 3,255,659 | A * | 6/1966 | Venghiattis | 86/20.14 |
| 3,329,218 | A * | 7/1967 | Bell | 175/4.54 |
| 3,375,108 | A * | 3/1968 | Wyman, Sr. et al. | 419/5 |
| 4,551,287 | A * | 11/1985 | Bethmann | 264/3.1 |
| 4,658,900 | A * | 4/1987 | Stout | 166/297 |
| 4,829,901 | A * | 5/1989 | Yates, Jr. | 102/306 |
| 4,850,438 | A * | 7/1989 | Regalbuto | 175/4.56 |
| 5,216,197 | A * | 6/1993 | Huber et al. | 102/317 |
| 5,331,895 | A * | 7/1994 | Bourne et al. | 102/307 |
| 5,347,929 | A | 9/1994 | Lerche et al. | |
| 5,505,134 | A | 4/1996 | Brooks et al. | |
| 5,615,465 | A * | 4/1997 | Broussoux et al. | 89/1.151 |
| 6,385,031 | B1 | 5/2002 | Lerche et al. | |
| 6,386,108 | B1 | 5/2002 | Brooks et al. | |
| 6,837,310 | B2 | 1/2005 | Martin | |
| 7,347,278 | B2 | 3/2008 | Lerche et al. | |
| 7,549,373 | B2 | 6/2009 | Brooks et al. | |
| 7,581,498 | B2 * | 9/2009 | Hetz et al. | 102/306 |
| 7,762,331 | B2 * | 7/2010 | Goodman et al. | 166/299 |
| 7,762,351 | B2 * | 7/2010 | Vidal | 175/4.6 |
| 2005/0178282 | A1 | 8/2005 | Brooks et al. | |
| 2005/0247450 | A1 | 11/2005 | Ratanasirigulchai et al. | |
| 2006/0272756 | A1 | 12/2006 | Kneisl et al. | |
| 2008/0149338 | A1 | 6/2008 | Goodman et al. | |

FOREIGN PATENT DOCUMENTS

| | | | |
|---|---|---|---|
| EP | 651229 | A2 | 5/1995 |
| EP | 675262 | A1 | 10/1995 |
| EP | 651229 | A3 | 11/1995 |
| EP | 651229 | B1 | 10/1997 |
| EP | 675262 | B1 | 11/1999 |
| GB | 2288005 | A | 10/1995 |
| GB | 2388420 | A | 11/2003 |
| GB | 2395962 | A | 6/2004 |
| GB | 2405423 | A | 3/2005 |
| GB | 2406870 | A | 4/2005 |

(Continued)

*Primary Examiner* — Benjamin P Lee
(74) *Attorney, Agent, or Firm* — Rodney Warfford; Chad Sullivan; Brandon Clark

(57) ABSTRACT

An initiator device, comprising an explosive foil initiator; an initiator shaped charge that is activated by the explosive foil initiator; the initiator shaped charge comprising an outer casing having an opening therein defining a volume, an explosive located inside the opening, the explosive defining a concave cavity therein; a metal liner lining the concave cavity; and a detonation cord that is activated by the initiator shaped charge.

13 Claims, 3 Drawing Sheets

FOREIGN PATENT DOCUMENTS

| | | | |
|---|---|---|---|
| GB | 2406871 | A | 4/2005 |
| GB | 2411222 | A | 8/2005 |
| GB | 2426974 | A | 12/2006 |
| GB | 2435645 | A | 9/2007 |
| WO | 0022279 | A1 | 4/2000 |
| WO | 2008079481 | A1 | 7/2008 |

* cited by examiner

MINIATURE SHAPED CHARGE FOR INITIATOR SYSTEM

PRIORITY

The present application clams priority to U.S. Provisional Patent Application No. 61/140,949 filed on Dec. 27, 2008, such being incorporated by references in its entirety.

TECHNICAL FIELD

The present application relates to shaped charges, and more particularly to a shaped charge explosive pellet used in conjunction with an initiation design.

BACKGROUND

Hydrocarbons and other desirable fluids are located below the earth's surface and/or below the seafloor. To gain access to the hydrocarbons a well is drilled into the earth. The well is normally cased with a metal casing that is secured in place by cement. To produce the hydrocarbons it is often advantageous to perforate portions of the casing to allow hydrocarbons and other reservoir fluids to flow from the formation through the perforations and into the casing. Once the hydrocarbons are inside the casing they can be produced to the surface.

The perforations are commonly created using shaped charges. Shaped charges have a case, explosive material, and an inverted conical liner. The internal shaped charge geometry is arranged such that when the explosive initiates, the case confines the detonation, and the inverted conical liner collapses to produce a high-pressure jet of liner material. When a shaped charge is used in an oil well, the jet that is produced penetrates the casing, cement, and reservoir rock.

Shaped charges are generally delivered into an oil well using a perforating gun, which is a specially designed longitudinally extending tubular device. Shaped charges are commonly arranged in a perforating gun such that each charge is located in close proximity to a detonating cord. The detonating cord extends along the perforating gun and may be initiated in a variety of ways depending on the situation.

The present application relates to and describes a design for advantageously initiating the detonation cord by utilizing a miniature shaped charge.

DETAILED DESCRIPTION

The following description concerns a number of embodiments and is meant to provide an understanding of the embodiments. The description is not in any way meant to limit the scope of any present or subsequent related claims.

As used here, the terms "above" and "below"; "up" and "down"; "upper"and "lower"; "upwardly" and "downwardly"; and other like terms indicating relative positions above or below a given point or element are used in this description to more clearly describe some embodiments. However, when applied to equipment and methods for use in wells that are deviated or horizontal, such terms may refer to a left to right, right to left, or diagonal relationship as appropriate.

Figure 1:
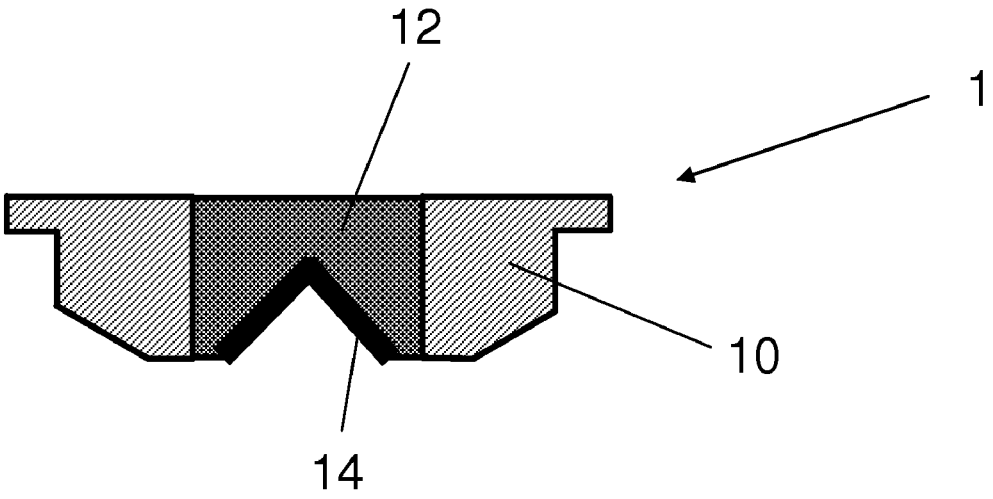
FIG. 1 is a cross-sectional schematic of a miniature shaped charge initiator device according to an embodiment.

FIG. 1 shows an embodiment of a miniature initiator shaped charge 1 according to an embodiment. The initiator shaped charge 1 includes a casing 10 that has an opening therein that contains explosive 12. Preferably the explosive 12 is high explosive, e.g., Nonanitroterphenyl (abbreviated Nona) or hexanitrostilbene (abbreviated HNS). Nona and HNS are commercially available and therefore not described in excessive detail in the present application. The explosive 12 defines an indentation that is preferably conical in shape. A liner 14 is located in the indentation and adjacent to the explosive 12. Preferably the shape of the liner 14 conforms to the shape of the indentation, e.g., conical, and is directly against the explosive 12. FIG. 1 shows that the explosive 12 is exposed on one side of the opening in the casing 10 and is covered by the liner 14 on the opposite side. Preferably the liner 14 is metal.

The initiator shaped charge 1 is made by a process according to an embodiment involving locating, e.g., pressing, a metal cone 16 made from a first metal having a coating (liner material) of a second metal 14, into the explosive 12. The metal cone 16 of the first metal should have different solubility characteristics than the liner 14. A preferable embodiment includes using a solid copper cone 16 coated with a second metal liner part 14 that is not soluble in nitric acid (i.e. gold, etc.). The bottom of the cone 16 is not coated with the liner 14 material so that immersion in a solvent, e.g., nitric acid, results in removal of the copper cone 16 leaving the coating behind to form the liner. In this manner, a miniature shaped charge is produced having a metal liner 14 in the shape of an inverted cone.

Several embodiments are capable of accomplishing coating of the cone 16 with a liner 14 material. One is sputter coating, which involves the cone 16 being placed on a cathode plate beneath a sputtering target of the desired coating material in a vacuum chamber. When a voltage is applied to the sputtering target under vacuum, metal ions are produced within the chamber and are attracted to the cathode plate (i.e., cone 16) thereby creating a coating on any exposed surface of the copper cone 16. In this scenario, the cone 16 should be placed on its base to avoid coating with the liner 14 material in that region. Electroplating is another possible manner for producing the coating.

Figure 2:
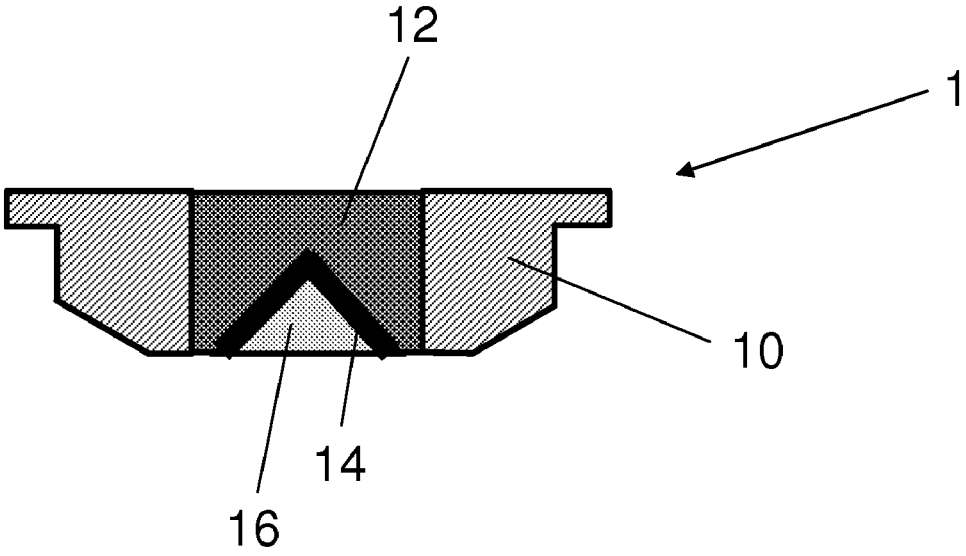
FIG. 2 is a cross-sectional schematic relating to manufacture of the device shown in FIG. 1.

FIG. 2 shows an embodiment relating to the manufacturing description above including a cone 16.

Figure 3:
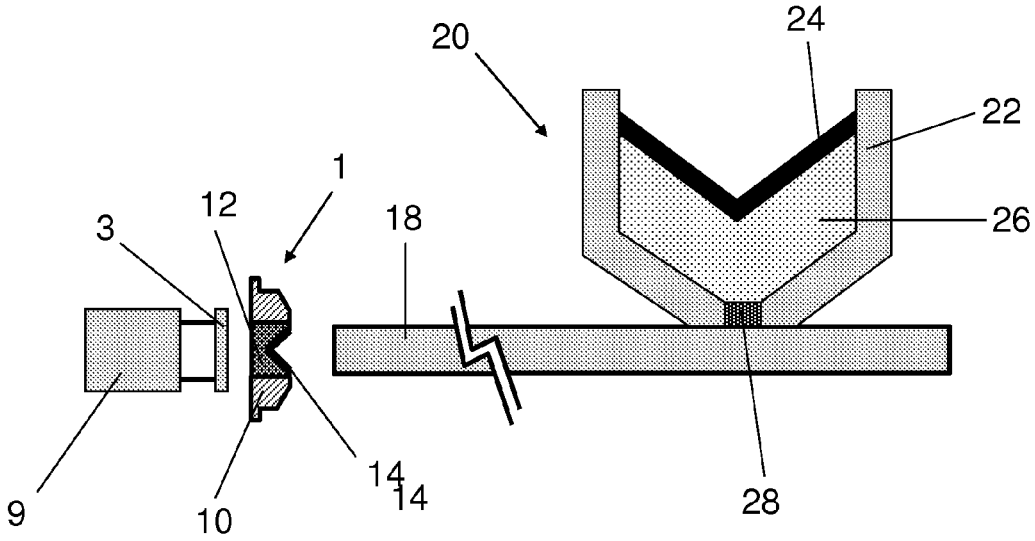
FIG. 3 is a schematic showing an embodiment of an initiation design whereby the detonation cord is initiated from its end.
Figure 4:
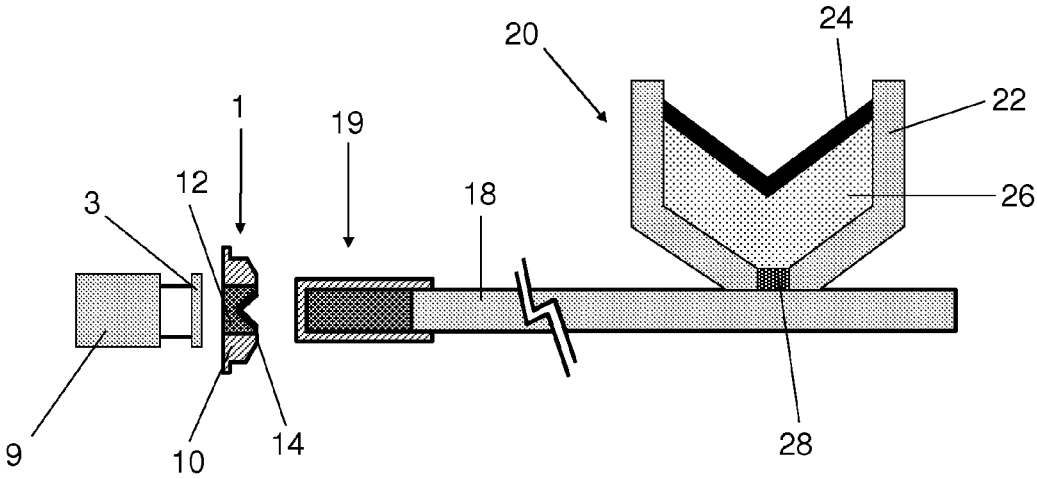
FIG. 4 is a schematic showing an embodiment of an initiation design whereby the detonation cord is initiated with the aid of an explosive booster.
Figure 5:
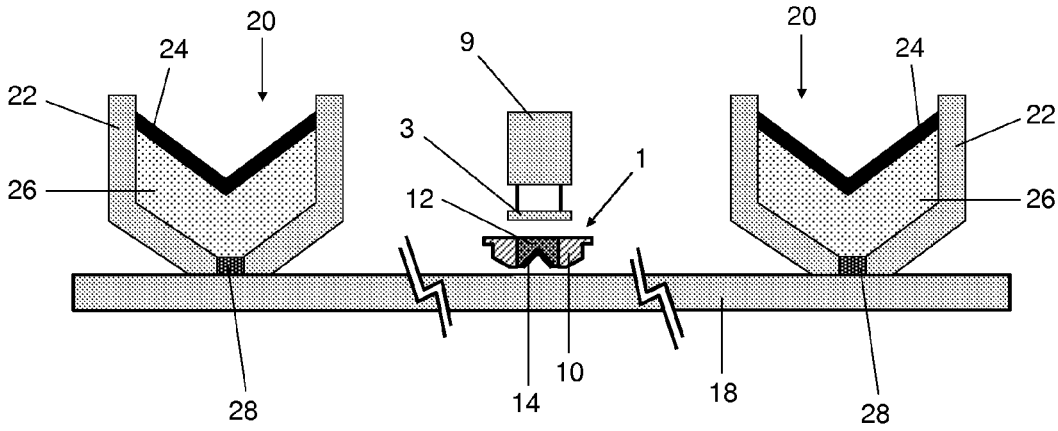
FIG. 5 is a schematic showing an embodiment of an initiation design whereby the detonation cord is initiated via a perpendicular miniature shaped charge.
Figure 6:
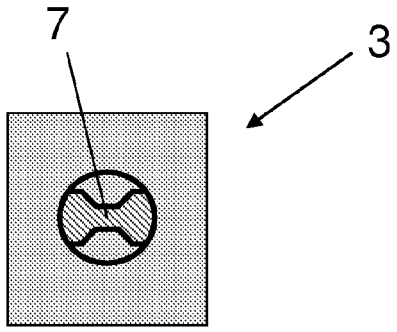
FIG. 6 is a schematic showing the low-resistance bridge used in an explosive foil initiator.

FIGS. 3, 4, and 5 shows schematics of initiation designs according to the present application. An explosive foil initiator device 3 (depicted in FIGS. 3, 4, and 5) is shown in FIG. 6 from a front-on view. A capacitor 9 is connected electrically with a low-resistance electric bridge 7. When the capacitor 9 is charged and that energy released, the low electrical resistance of the bridge results in a high flow of current that causes the bridge to explode, propelling material at a high velocity into the exposed portion of the explosive 12 in the initiator shaped charge 1. The explosive then initiates, collapsing the liner 14 and forming a high-pressure jet. In FIGS. 3 and 5, the jet directly impacts the detonating cord 18 causing the detonating cord 18 to initiate. As shown in FIG. 4, the jet impacts and initiates an explosive-loaded booster 19, which in turn initiates the detonating cord 18. It is, however, preferable to remove the requirement for a booster, as the miniature shaped charge is capable of directly initiating detonating cord. Later in the explosive train, the detonating cord 18 is located near a shaped charge 20 and initiates the shaped charge 20. The shaped charge 20 can include a case 22, a liner 24, explosive between the case 22 and the liner 24, and an explosive primer region 28.

The detonating cord 18 leads to a shaped charge 20. The shaped charge 20 has a cuplike shaped case 22, a liner 24, and explosive 26 located between the case 22 and the liner 24. An explosive primer region 28 is integrated within the case 22 thereby assisting in the detonation of the explosive 26.

Advantageous aspects of the device are, for example, its simplicity, potential to use less explosive 12 by elimination of the explosive-loaded booster that exists in the current state-of-the-art, capability to directly initiate detonation cord 18 by way of the initiator shaped charge 1, and capability to initiate detonation cord from any location along its length within a perforating gun.

The embodiments described herein are meant to provide a full understanding of the embodiments, and are not meant in any way to limit the claims herein, or any subsequent related claims.

The invention claimed is:

1. A method for manufacturing a shaped charge, the method comprising:

depositing an explosive in a cavity housing;

pressing a liner member into the explosive so that a surface portion of the liner member engages the explosive, the surface portion having a first solubility and covering a support portion of the liner member having a second solubility different from the first solubility so that the support portion does not engage the explosive; and subjecting the housing and liner member to a solvent to provide a cavity within the liner member, the solvent selected so that the support portion of the liner member is soluble therein and the surface portion of the liner member is not soluble therein.

2. The method of claim 1, wherein the cavity of the liner member provided by subjecting the housing and liner member to a solvent has an inverted cone configuration.

3. The method of claim 1, wherein the solvent is nitric acid.

4. The method of claim 1, wherein the support portion of the liner member include copper.

5. The method of claim 1, wherein the surface portion of the liner member is gold.

6. The method of claim 1, wherein the explosive is nonanitroterphenyl.

7. The method of claim 1, wherein the explosive is hexanitrostilbene.

8. The method of claim 1 including applying the surface portion onto the support portion.

9. The method of claim 8, wherein applying the surface portion onto the support portion includes sputter coating.

10. The method of claim 8, wherein applying the surface portion onto the support portion includes electroplating.

11. The method of claim 1, wherein the housing includes an opening extending therethrough defining the cavity therein.

12. The method of claim 1, wherein the opening has a length extending through the housing and a constant surface area along the length.

13. The method of claim 1, wherein the surface portion of the liner member does not extend across the entire cavity.

* * * * *